United States Patent [19]

Renner

[11] 4,008,894

[45] Feb. 22, 1977

[54] RAILROAD TEETER SWITCH GAME

[76] Inventor: David L. Renner, Rte. 1, Wallace, Kans. 67761

[22] Filed: July 21, 1975

[21] Appl. No.: 597,439

[52] U.S. Cl. ..... 273/110; 273/153 S

[51] Int. Cl.[2] ..... A63F 7/04; A63F 9/08

[58] Field of Search ..... 273/110, 111, 153 R, 273/153 S

[56] References Cited

UNITED STATES PATENTS

| | | | |
|---|---|---|---|
| 268,920 | 12/1882 | Meier | 273/153 S UX |
| 1,201,974 | 10/1916 | Kohler | 273/110 |
| 1,367,232 | 2/1921 | Bradley | 273/110 |
| 3,879,039 | 4/1975 | Holden | 273/110 |

FOREIGN PATENTS OR APPLICATIONS

| | | | |
|---|---|---|---|
| 986,822 | 4/1951 | France | 273/110 |
| 9,786 | 7/1884 | United Kingdom | 273/153 S |

*Primary Examiner*—Anton O. Oechsle
*Attorney, Agent, or Firm*—John H. Widdowson; Edwin H. Crabtree

[57] ABSTRACT

A railroad teeter switch game having parallel channels interconnected in a game board. The channels representing a railroad main track and railroad return tracks. Roller balls are used to represent a railroad engine, a railroad caboose, and other railroad cars and are rolled back and forth in the tracks by tilting the board. By skillfully opening and closing switches at the end of the main track and using the return tracks, the players of the game can reverse the order of the roller balls in the main track, thereby achieving the object of the game.

5 Claims, 6 Drawing Figures

RAILROAD TEETER SWITCH GAME

BACKGROUND OF THE INVENTION

This invention relates generally to a game board and more particularly, but not by way of limitation, to a railroad teeter switch game using roller balls.

There are a number of different types of game boards using marbles that ride in grooves representing train tracks. There are also game boards that use a pivot member to tilt the game board and roll the marbles used in the game. Also, switches are used in combination with a game board, to control the direction and movement of the marbles. None of the railroad game boards disclose the novel teeter switch game board as further described.

SUMMARY OF THE INVENTION

The subject invention tests the skill of a player by rolling colored roller balls representing a railroad train in a main channel in the game board. By opening switches at the end of the main channel, the roller balls can be diverted to return channels. By tilting the game board, the roller ball in the return channel is returned to the roller balls remaining in the main channel, but in a different order.

The railroad teeter switch game includes a game board with a pivot attached to the center of the board for tilting the top and bottom portion of the board. Parallel channels representing a main channel and return channels are interconnected for receiving and returning roller balls riding in the channels. While tilting the board back and forth, the game players can open and close switches at the end of the main channels to allow the roller balls to enter the return channels.

The advantages and objects of the invention will become evident from the following detailed description when read in conjunction with the accompanying drawings which illustrate a preferred embodiment of the invention.

DETAILED DESCRIPTION OF THE DRAWINGS

Figure 1:
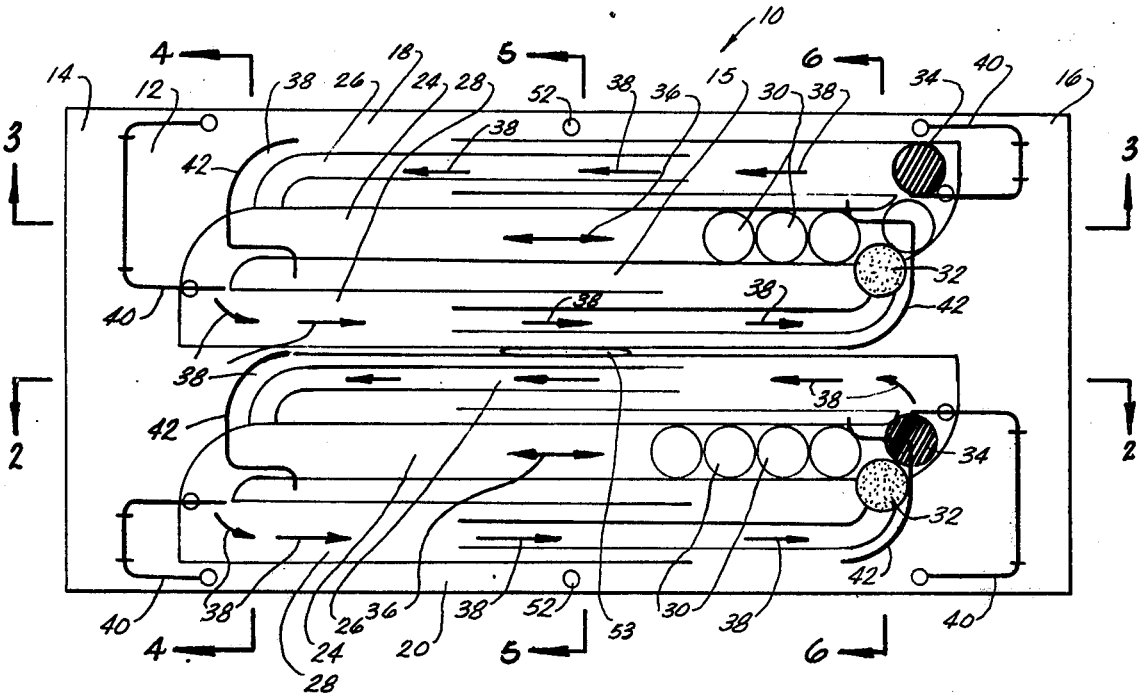
FIG. 1 is a top view of the railroad teeter switch game board.
Figure 2:
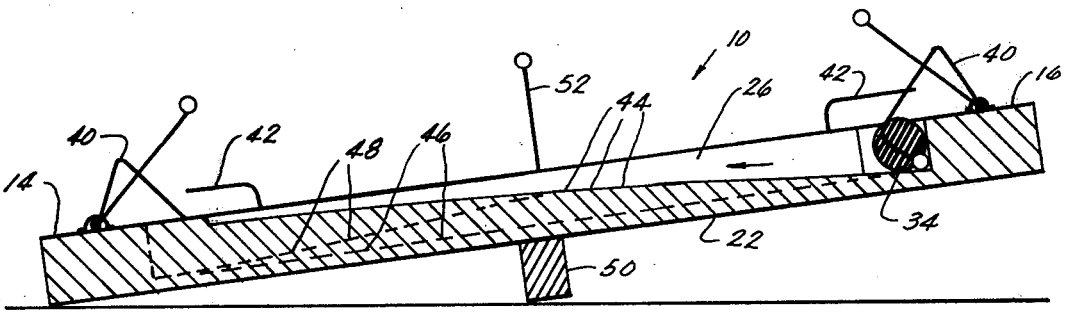
FIG. 2 is a cross section of the game board along section 2—2 of FIG. 1.
Figure 3:
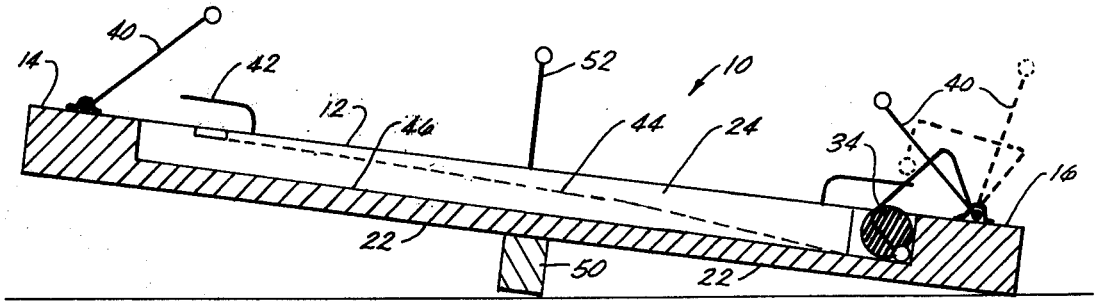
FIG. 3 is a cross section of the game board along section 3—3 of FIG. 1.

In FIG. 1 the railroad teeter switch game board is illustrated by general reference character 10. The board 10 includes a front portion 12, a top portion 14, a center portion 15, a bottom portion 16, a side portion 18, a side portion 20, and a back portion 22. The back portion 22 is shown in FIGS. 2 and 3. The front portion 12 includes main channels 24 and inclined return channels 26 and 28. Clear colored roller balls 30 represent railroad cars, solid roller balls 32 represent the railroad caboose and striped roller balls 34 represent the railroad engine. Arrows 36 represent the direction the roller balls roll in the main channels 24, which in the main channels 24 is in both directions. Arrows 38 represent the direction the roller balls roll in the return channels 26 and 28. The roller balls enter the return channels 26 and 28 by opening switches 40 which are positioned at the end of the main channels 24. The roller balls are guided back to the main channels 24 for the return channels 26 and 28 by curved bumpers 42 positioned at the top of the inclined portion 44 and 48 (shown in FIG. 2 and 3) of the return channels 26 and 28.

Between the parallel main channels 24 and return channels 26 and 28 positioned in the center portion 15 of the board 10 is a game card slot 53. Slot 53 is used to hold the players game cards. The game cards tell the players the number of the train to be used, the color of the roller balls to be used and the starting and finished position of the train.

FIG. 2 illustrates a cross section of the board 10 showing the inclined portion 44 of the return channel 26. Dotted lines 46 show the bottom portion of main channel 24 and dotted lines 48 show the inclined portion of the return channel 28. In this figure it can be seen that the return channels 26 and 28 are inclined in opposite directions from each other. The board 10 is tilted by a pivot member 50 attached to the bottom portion 22 of the board 10 and positioned in the center of the board 10. The board 10 is shown tilted with the top portion 14 down. The board also includes vertical pins 52 attached to the top portion 12 for assisting the game players is tilting the game board 10 back and forth.

The game board 10 in FIG. 3 is tilted with the bottom portion 16 down. This cross section shows the bottom portion 46 of the main channel 24, which is parallel to the surface of the game board's front portion 12. This illustration shows the switch 40 in a closed position and in an open position shown as dotted lines. The inclined portion 44 of the return channel 26 is also shown as dotted lines.

Figure 4:
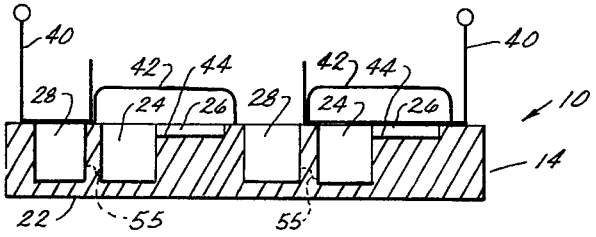
FIG. 4 is a cross section of the game board along section 4—4 of FIG. 1.

FIG. 4 illustrates a cross section of the top portion 14 of the game board 10. This figure shows the ends of the main channels 24 and the ends of the inclined channels 28 at the same depth so that when the switch 40 is opened, the roller ball will enter the inclined channel 28. A raise 55 is shown in dotted lines between the ends of the channels 24 and 28. Raise 55 prevents the roller balls from rolling back into the main channel 24 from the return channel 28 when switch 40 is open. The top of the inclined portion 44 of the channel 26 is also shown.

Figure 5:
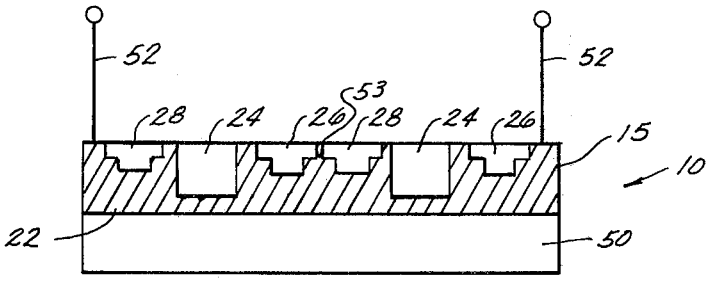
FIG. 5 is a cross section of the game board along section 5—5 of FIG. 1.

FIG. 5 illustrates a cross section of the center portion 15 of the game board 10 with the back portion 22 attached to pivot member 50. In this figure, the depth of the inclined channels 26 and 28 are substantially the same. A cross section of the game card slot 53 is also shown.

Figure 6:
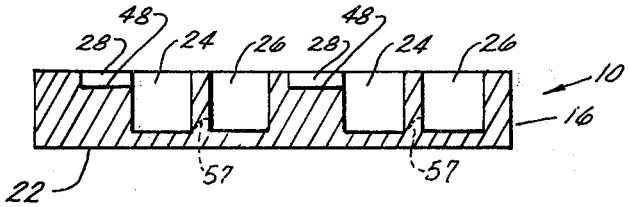
FIG. 6 is a cross section of the game board along section 6—6 of FIG. 1.

In FIG. 6 the board 20 is shown in cross section at the bottom portion 16. In this illustration the ends of the main channels 24 and the ends of the inclined channels 26 are at the same depth so that the roller ball in the main channel 24 can enter the return channel 26. A raise 57 similar to raise 55 is shown in dotted lines to prevent the roller ball from rolling back into the main channel 24 from the return channel 26 when switch 40 is open. The top of the inclined portion 48 of the channel 28 is also shown.

In operation the railroad teeter switch game can be played with the striped ball 34 representing the engine, the solid color ball 32 representing the caboose, and any number of other roller balls representing the railroad cars as long as there is an equal number of roller balls used by each player. The roller balls are placed in the main channels 24 with the striped ball 34 at one end of the line of balls and the solid ball 32 at the other end. By tilting the board 10 back and forth on the pivot member 50, the roller balls are rolled from one end of the main channel 24 to the other.

As the board 10 is tilted back and forth, each player has the opportunity of opening and closing switches 40 to receive the roller balls in the return channels 26 and 28. When a roller ball is recieved in a return channel 26 and 28 and the board 10 is tilted in the opposite direction, the return channel guides the roller ball back to the main channel 24 with the help of the curved bumpers 42, but the ball is returned to the line of balls in a different position depending on whether the switch 40 is open or closed. It can be seen in FIG. 1, that by placing the curved bumpers 42 at various positions at the end of the return channels 26 and 28, the roller ball is returned at different positions in the line of roller balls in the main channel 24. In FIG. 1 the ball 32 is returned to the line of balls between ball 34 and the first of the balls 30 if the switch 40 is closed. If the switch 40 is open, the ball 32 is returned between the first ball 30 and the second ball 30.

The players by skillfully opening and closing the switches 40 and knowning the position a roller ball will be returned to the line of balls, can successfully reverse the order of the roller balls in the main channel 24. The first player who reverses the roller balls accomplishes the object of the game and is the winner of the novel railroad teeter switch game.

Changes may be made in the construction and arrangement of the parts or elements of the various emboidments as disclosed without departing from the spirit and scope of the invention as defined in the following claims.

I claim:

1. A railroad teeter switch game using colored roller balls, the individual balls representing a railroad engine, a railroad caboose, and other railroad cars, the game comprising:

colored roller balls;

a game board;

pivot means attached to said board for tilting said board;

a main channel in said board, said main channel parallel to the sides of said board, said main channel receiving said roller balls for rolling therein;

return channels in said board, said return channels positioned on either side of said main channel and parallel thereto, said return channels attached at both ends to said main channel for receiving and returning the roller balls to said main channel; said return channels are inclined in opposite direction so that said game board when tilted in one direction one of said return channels will receive one of said rollers balls from said main channel while said other return channel will return another of said roller balls to said main channel, when said game board is tilted in the other direction said other return channel will receive one of said roller balls from said main channel while said return channel will return another of said roller balls to said main channel; and a plurality of switches attached to said board, said switches positioned at each end of said main channel to control the flow of the roller balls into said return channels as said game board is tilted;

said main channel repesenting a railroad track, said return channels repesenting railroad return tracks.

2. The game as described in claim 1 further including a plurality of main channels, interconnected to return channels so that more than one game player can play the game in opposition to one another and at the same time.

3. The game as described in claim 1 further including vertical upstanding pins attached to the game board and positioned in the center thereof, said pins used in cooperation with said pivot means to tilt said board.

4. The game as described in claim 1 further including curved bumpers attached to said board and positioned at the end of of said inclined return channels to guide the roller balls back into said main channel.

5. The game as described in claim 1 wherein said curved bumpers are attached at different locations at the end of the return channels so that the roller balls are guided back to different positions in the line of roller balls in the main channel when the board is tilted.

* * * * *